United States Patent [19]

Nolan

[11] Patent Number: 4,973,043

[45] **Date of Patent: * Nov. 27, 1990**

[54] EXERCISE DEVICE

[76] Inventor: Timothy J. Nolan, 3801 Jay, Rolling Meadows, Ill. 60008

[ * ] Notice: The portion of the term of this patent subsequent to Sep. 26, 2006 has been disclaimed.

[21] Appl. No.: 277,896

[22] Filed: Nov. 30, 1988

Related U.S. Application Data

[63] Continuation-in-part of Ser. No. 125,545, Nov. 25, 1987, Pat. No. 4,869,491.

[51] Int. Cl.[5] ..... A63B 5/00; A63B 21/02

[52] U.S. Cl. ..... 272/67; 272/68; 272/140

[58] Field of Search ..... 272/67, 68, 140, 141, 272/142, 75, 122, 93, 143, 901, 902, 126, 127, 132

[56] References Cited

U.S. PATENT DOCUMENTS

| | | | |
|---|---|---|---|
| 3,132,861 | 5/1964 | Horney | 272/68 |
| 3,184,234 | 5/1965 | Struble | 272/68 |
| 4,203,591 | 5/1980 | Gibson | 272/67 |
| 4,591,151 | 5/1986 | Hensley | 272/67 |
| 4,643,417 | 2/1987 | Nieman | 272/67 |
| 4,869,491 | 9/1989 | Nolan | 272/68 |

*Primary Examiner*—Stephen R. Crow

*Attorney, Agent, or Firm*—Fitch, Even, Tabin & Flannery

[57] ABSTRACT

An exercise device including a pair of nonaligned hand grips rotatably mounted on a nonlinear bar and spring biased to provide adjustable resistance to motion through predetermined symmetrical strokes. The device preferably includes detachable auxiliary weights which enable the total weight of the device to be adjusted. The spring biasing force applied to the grips is preferably individually adjustable for each grip.

2 Claims, 2 Drawing Sheets

FIG. 1
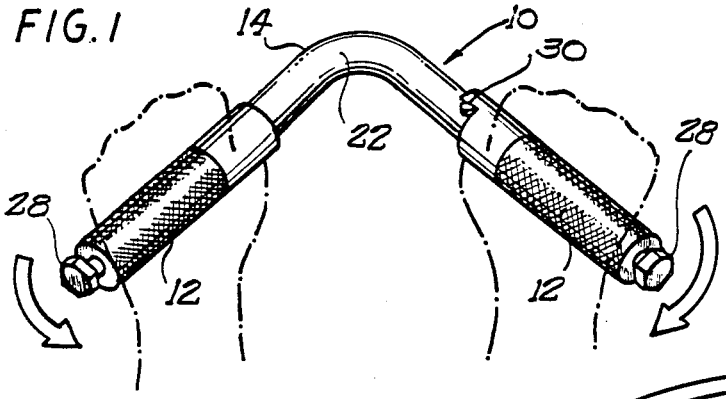
FIG. 2
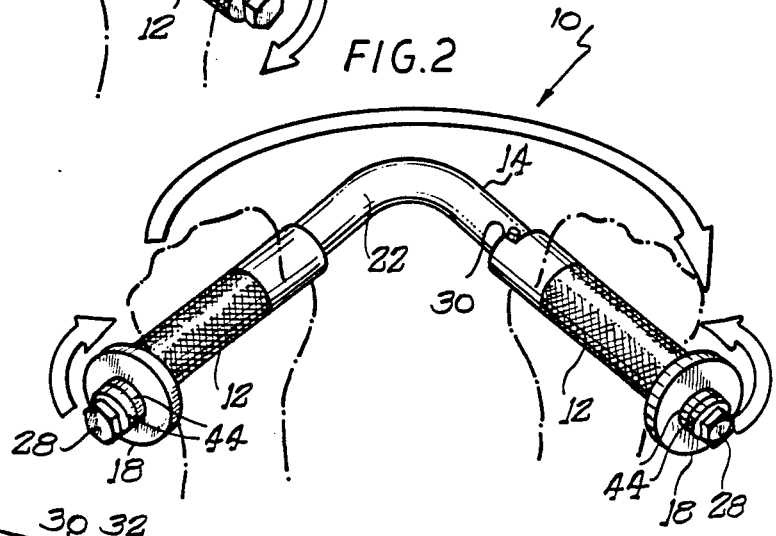
FIG. 3
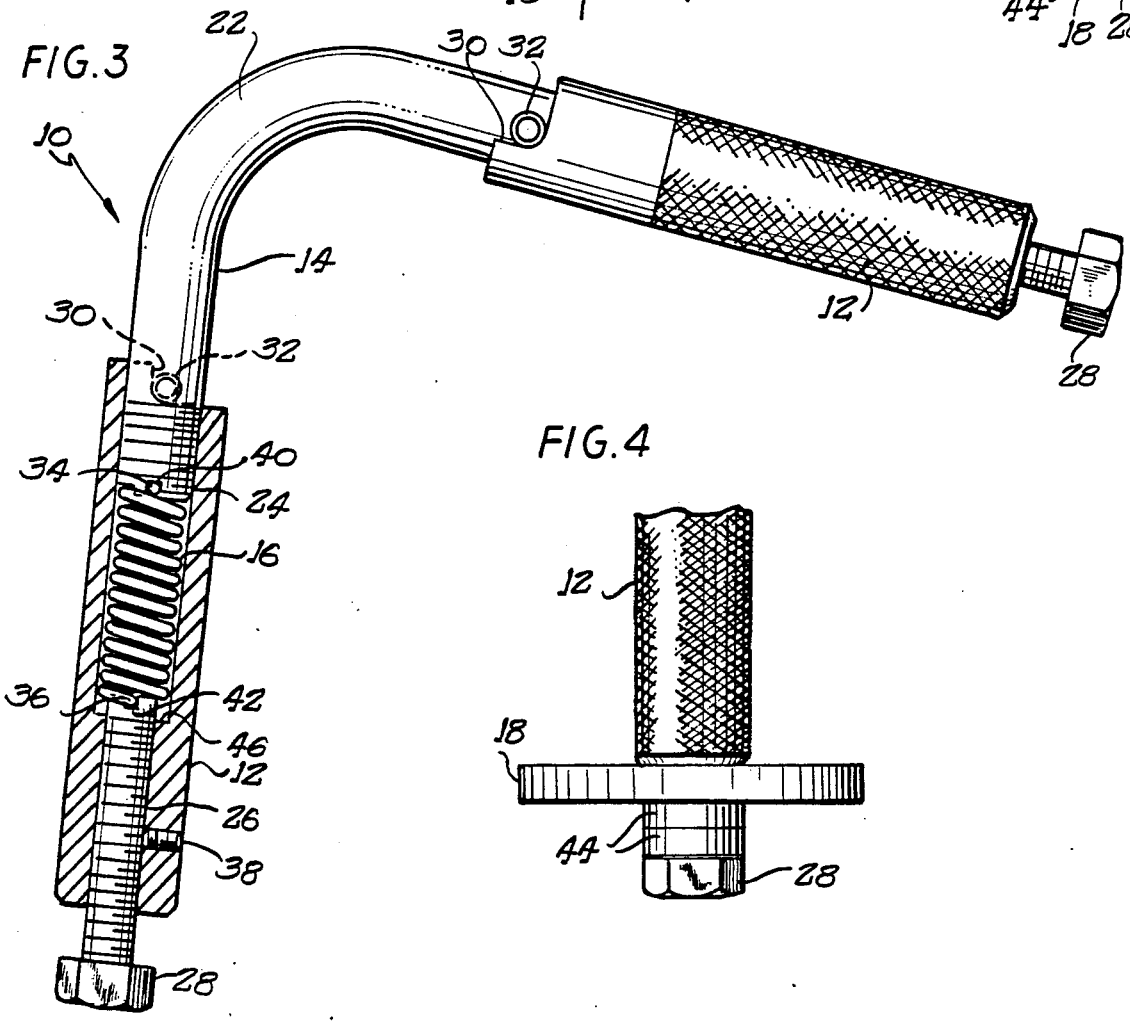
FIG. 4

EXERCISE DEVICE

This application is a continuation-in-part of U.S. Patent Application Ser. No. 125,545, filed Nov. 25, 1987, now U.S. Pat. No. 4,869,491.

BACKGROUND OF THE INVENTION

The invention relates generally to exercise devices, and more particularly to a device for use in an exercise where the user rotates a pair of grips.

One type of exercise device employs a friction clutch to resist rotation of hand grips. An example of such a device is described in U.S. Pat. No. 4,203,591.

Other exercise devices employ springs to provide relative resistance between a pair of axially aligned hand grips. An example of this type of device is described in U.S. Pat. No. 4,095,789.

One difference between the friction device and the spring-loaded device is that in the latter, the springs maintain torque in a predetermined direction on the grips through a predetermined range of motion, regardless of whether the grips are being rotated, whereas in the friction device, the friction clutch only applies torque to a grip during rotation of the grip, in a direction opposite to rotation of the grip. Thus, with the latter type of device, when the user rotates a grip in reciprocating motion, the muscles are able to apply force in a single rotational direction while moving alternately in opposite directions.

In devices having aligned rotatable grips, when the user applies torque to one of the grips, he or she must apply oppositely-directed torque of equal magnitude to the opposite grip in reaction thereto. The user accordingly cannot apply torque to either grip in excess of the torque he is capable of applying to the other grip in the opposite direction. The present invention pertains to a device which is not so limited, and which is believed to provide various other advantages over the prior art.

Accordingly, it is a general object of the present invention to provide an improved exercise device of the type having rotatable hand grips and means for providing resistance to rotation thereof.

It is an additional object of the present invention to provide an exercise device which is relatively economical to manufacture, relatively compact, and adjustable to permit variation of resistance to twisting of hand grips.

Further objects and advantages of the invention will become apparent from the detailed description set forth below, and the accompanying drawings.

SUMMARY OF THE INVENTION

In accordance with the invention, there is provided an exercise device including a pair of nonaligned hand grips which are rotatably mounted on a nonlinear bar and spring-biased to provide adjustable resistance to motion through predetermined symmetrical strokes. The device preferably includes detachable auxiliary weights which enable the total weight of the device to be adjusted The spring biasing force applied to the grips is preferably individually adjustable for each grip. The orientation of the biasing means, enabling symmetrical rotation of the grips against spring torsion, enables the user to move both arms and hands in identical, symmetrical motion in an exercise, with either the same force resisting torsion of each grip, or a selected difference in the torsional resistance to rotation between the two grips. The springs are preferably coil springs which are disposed within the respective grips. The device is designed so as to be compact, relatively simple to manufacture, and relatively simple to adjust.

BRIEF DESCRIPTION OF THE DRAWINGS

FIG. 1 is a perspective view of an exercise device in accordance with the invention.

FIG. 2 is a perspective view of the device of FIG. 1, in combination with a pair of auxiliary weights.

FIG. 3 is a plan view of the device of FIG. 1, shown partially in section.

FIG. 4 is a fragmentary view of an end portion of the device of FIG. 1, shown in combination with an auxiliary weight.

DETAILED DESCRIPTION OF THE PREFERRED EMBODIMENTS

Figures 5, 6, 7, 8, 9, 10:
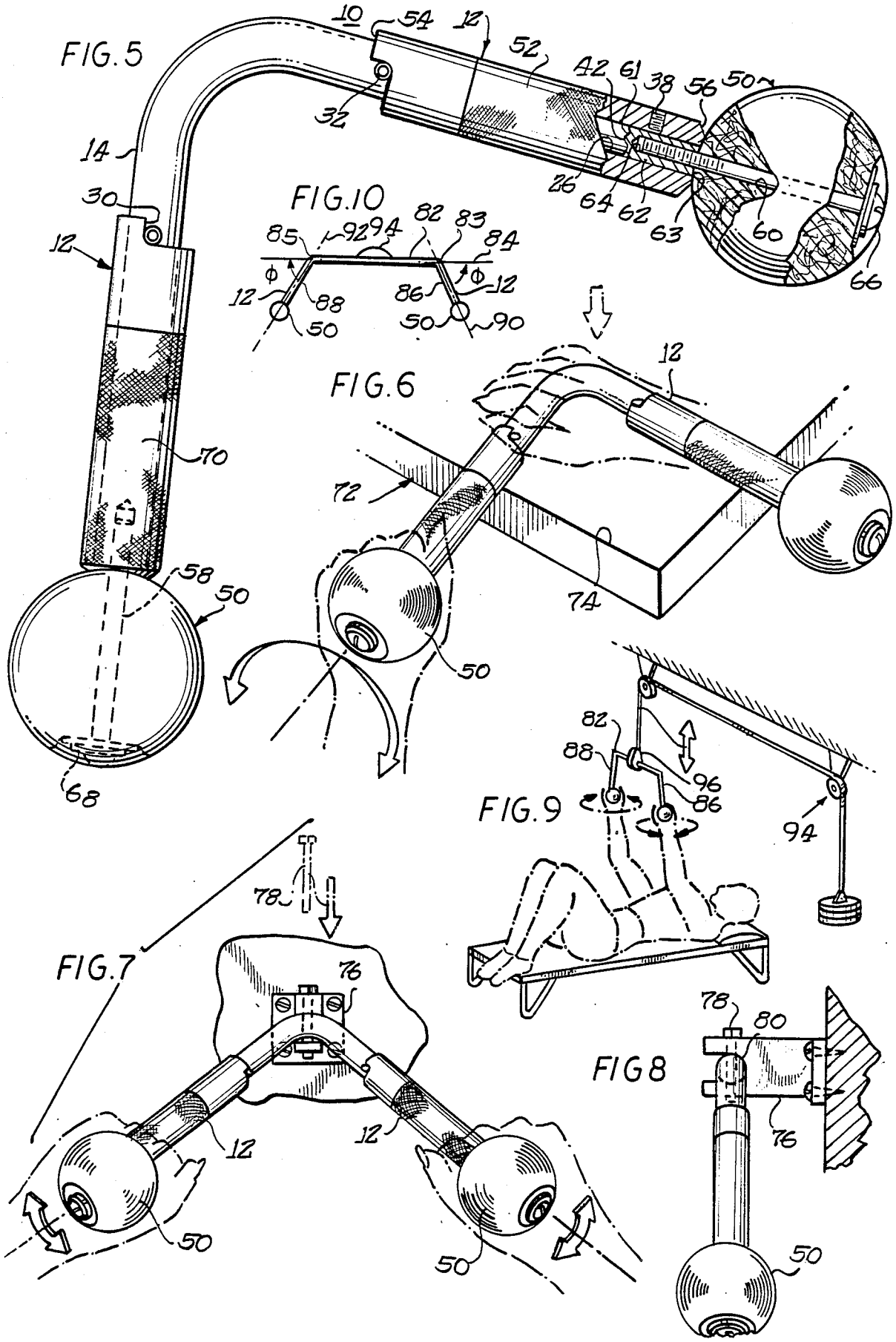
FIG. 5 is a plan view of an alternative embodiment in partial cross-section.
FIG. 6 illustrates an operable mode for utilizing a single grip.
FIG. 7 illustrates the operation of the device in a fixed wall mounting.
FIG. 8 is a side view of the device mounted in a wall bracket.
FIG. 9 is a second alternative embodiment with a linear bar interposed between the generally linear end portions and its operation with a variable weight and pulley system.
FIG. 10 is a plan view of the bar of FIG. 9 with an eye-hook for attachment to a variable weight system.

The invention is generally embodied in an exercise device 10 which comprises a pair of rotatable grips 12, disposed on opposite ends of a nonlinear bar 14. The bar 14 is preferably generally V-shaped. Each of the grips 12 has a limited range of rotational motion during use, and is biased for rotation in a predetermined direction relative to the bar 14.

In accordance with one feature of the invention, the grips 12 are biased for rotation by a pair of torsion springs 16 disposed internally of the grips to apply torque to the grips 12 such that the grips 12 may be reciprocated symmetrically with respect to one another, so that a user may exercise both arms in the same manner at the same time with the device 10. Thus, as illustrated in FIG. 1, the user may hold the grips and rotate both of his or her wrists outwardly together, opposed by the spring load, and at the end of the outward motion, the user may reduce the torque manually applied to the grips 12, and the springs 16 will return the grips to their initial positions.

In accordance with another feature of the invention, the user may, by rotating the device 10 180°, as indicated in FIG. 2, orient the device so that it is suitable for a second exercise in which the spring load opposes inward rotation of both of the grips 12.

In accordance with an additional feature of the invention, auxiliary weights 18 are provided which are attachable to the device adjacent the grips 12. It is intended that the device be used while held in front of the user, about chest high, and the additional weights 18 provide more strenuous exercise for various muscle groups, due to the added weight necessary to maintain the device in position during the rotation of the grips 12. The illustrated weights 18 are relatively small, and in other embodiments of the invention larger, heavier weights than those illustrated herein may be used.

In accordance with a further feature of the invention, the biasing force is independently adjustable for each grip 12. This enables the user to make rotation of one grip more difficult than the other if desired, as well as enabling the user to increase or decrease the spring load on both grips in a like manner.

Turning to a more detailed description of the preferred embodiment of the invention, the bar 14 preferably has a pair of substantially linear, threaded end portions 20 joined by a curved central portion 22. In the illustrated embodiment, the bar 14 defines an included angle of about 80°, and is coplanar.

The grips 12 are preferably tubular sleeves, each having an internally-threaded bore. In the illustrated embodiment, the bore is stepped, including a first threaded portion 24 of relatively large diameter for receiving an end portion 20 of the bar 14, and a second threaded portion 26 of smaller diameter for receiving an adjustment bolt 28.

Each of the grips 12 has a pair of shoulders 30 defined thereon for engaging a stop 32 on the bar 14. The stop 32 on the bar is preferably a screw or bolt. When the device is not in use, the shoulders 30 are biased against the grips by the springs 16. The stops 32 cooperate with the shoulders 30 to define a predetermined range of motion for each of the grips 12. In the illustrated embodiment, the shoulders 30 on each grip are about 180° apart, to provide a range of motion of about 180°. The exterior surfaces of the grips 12 are preferably knurled over a portion of their length to aid in gripping by the user's hands.

The coil spring 16 for each grip 12 is disposed within the large-diameter portion 24 of the bore of the grip 12, having its inner end 34 connected to the bar 14 and the opposite end 36 connected to the adjustment bolt 28. The bar 14 has a transverse slot 40 at each end to receive the inner ends 34 of the respective springs 16, and each of the adjustment bolts 28 similarly has a transverse slot 42 at its inner end to receive the outer end 36 of its associated spring 16. The adjustment bolt 28 is kept immovable relative to the grip by a set screw 38 during use of the device.

The threads of the small-diameter portion 28 of the bores of the grips 12 are of opposite hand, as are he threads of the two adjustment bolts 28. This enables the respective springs 16 to be preloaded in opposite directions by tightening of adjustment bolts 28, to provide for opposite-handed torsional spring-loading for the respective grips. Except for the difference in the thread orientation, the grips 12 are identical to one another.

The auxiliary weights 18 are preferably relatively flat disks, each having a central bore for the shaft of an adjustment bolt 28 to pass through. In FIG. 2, the device 10 is illustrated with two auxiliary weights 18 attached thereto, one associated with each of the grips 12. Additional weights 18 may be installed, and annular spacers 44 are provided to stabilize the weights. The spacers 44 are disposed on each adjustment bolt 28, between the head of the bolt and the weight or weights 18 mounted thereon.

To assemble the device 10, the first step is to insert the inner ends 34 of the springs into the slots 40 in the ends of the bar 14, and to screw the grips 12 onto the bar 14 to a position where the shoulders 30 are disposed at the proper axial locations for engagement with the stops 32. The stops 32 are then inserted into transverse threaded bores in the bar 14.

Once the grips 12 are in place, the adjustment bolts 28 are screwed into the smaller bores 26 one at a time. When the leading end of an adjustment bolt 28 reaches the larger bore 24 of its associated grip 12, the groove 42 in the leading end of the bolt 28 engages the adjacent end 36 of the torsion spring 16. As the bolt rotates, groove 42 becomes aligned with the end 36 of the spring and receives the end 36. The spring 16 is compressed longitudinally, and the resilience of the spring locks the spring end 36 in the groove 42 so that subsequent rotation of the bolt 28 stresses the spring 16 torsionally. When the desired torsion is reached, the set screw 38 is tightened to lock the bolt 28 in place.

One advantage of the stepped bore in the grip 12 is that it facilitates removal of the adjustment bolt 28 from the grip 12, which is necessary in order to add or remove weights 18. The spring 16 is sized so that its diameter does not permit it to enter the smaller bore 26. As the end of the bolt 28 is withdrawn from the larger bore 24, the outer end 36 of the spring 16 abuts the annular surface which surrounds the entrance to the smaller bore 26, facilitating disengagement of the spring from the bolt 28.

An advantage of the provision of detachable auxiliary weights, as described above, is that the device can be used to exercise muscles of the upper arms and shoulders by virtue of the function of these muscles in supporting the weight of the device, at the same time the muscles of the wrists and forearms are being exercised by performance of a twisting motion. In the past, devices of this type have frequently been of negligible weight, or at least of fixed, relatively light weight, and have been therefore devoted entirely to wrist exercise. The present invention not only enables additional exercise benefit, but permits the total weight of the device to be adjusted to provide the maximum benefit for each particular user.

The action of the stops as described above also provides an advantage for the device 10, as compared with devices wherein the user works against a spring which is relaxed when the device is at rest. With such prior art devices, the device offers essentially no resistance at the beginning of each stroke. By contrast, with the above-described device 10, the grips are subjected to a torsional preload against the stops, so that the user encounters torsional resistance through the entire stroke of each grip.

In an alternative embodiment of device 10 shown in FIG. 5, grips 12 have a generally spherical auxiliary means for gripping 50. As the structure of the grips 12 and springs 16 have been noted above, the structure and operation of the auxiliary means for gripping 50 will be described for a single grip 12 but recognized as applying to the second handle grip 12 of device 10.

First rotatable grip 52 defines a first end 54 in proximity to bar 14 and a second or other end 56 to receive the adjusting means 28. Spherical gripping means 50 defines a through-bore 58 with side wall 60. Sidewall 60 may be threaded to mate with the threads of bolt 28. As shown in FIG. 3, bolt 28, the adjusting means for spring 16, may extend through bore 60 to again engage the threads of small bore 26, and the end of spring 16.

An adjustable insert 62, shown in FIG. 5, having an internal end 61 and an external end 63 may have a means for varying the insert, such as a slotted head for adjustment, and may be utilized as the adjustment means. Insert 62, which is also secured in position by set screw 38, defines a blind-hole threaded passage or bore 64 to receive securing means 66, shown as a threaded bolt and washer arrangement. In the illustrated device of FIG. 5 it is appreciated that, as shown, bolt 66 is a right-hand thread and bolt 68 of second handle grip 70 should be a left-hand thread to prevent the spherical auxiliary grips 50 from unscrewing during operation, which bolts have a head 67 and washer 69. Therefore, spherical grips 50, one of which is secured to each of first and second rotatable grips 52, 70, are operable to be grasped for rotating grips 52 and 70.

The spherical or orbital shape of the auxiliary gripping means further enhances usage of exercise device 10 by individuals who may experience difficulty in grasping a smaller handle. Examples of the latter type of individual are arthritis victims as well as rehabilitation patients recovering from broken wrists, hands or fingers. The spherical means 50 may have a rubber or tacky material surface to prevent slippage from moisture during usage of device 10.

FIG. 6 illustrates a method of utilizing only one of the rotatable grips, it is appreciated that this method is equally applicable to device 10 without auxiliary grips 50. In this operation device 10 is placed at the corner of a table or similar support 72 with balls 50 and at least part of rotatable grips 12 extending beyond table edge 74. Nonlinear bar 14 is firmly held on table 72 by one hand while the free hand of the user may operate the rotatable grip 12. As shown in the FIG. 6, the operator's right hand secures bar 14 to the table and his arm is generally parallel with the handle grip 12, while the left hand exercises by grasping the auxiliary grip 50. As noted above, the device 10 may be rotated 180° to permit the user to exercise the hand, wrist and arm in the opposite rotational direction.

FIGS. 7 and 8 demonstrate a mounting bracket 76 with device 10 secured therein at bar 14. Mounting bracket 76, which is secured to a wall or other fixed reference, includes a pin or bolt 78 to secure device 10 in the bracket slot 80. The bracket, slot and pin arrangement for securing the device 10 are merely exemplary and are not limitations, as it is appreciated that alternative securing means 76 are available to retain device 10 in a fixed location or position. In this fixed position, a user is free to operate both or one of the rotatable grips by either grasping the auxiliary grips 50, as shown, or the rotatable grip 12 knurled surface. As noted in FIG. 8, the bracket 76 must be displaced from the wall an adequate distance, which allows the user to rotate the grips 50 or 12 without inhibiting the motion of the user's hands.

FIGS. 9 and 10 show an alternative arrangement of device 10, which includes an elongated or linear bar 82 having a first end 83, a second end 85, and a longitudinal reference axis 84. Bar 82 is interposed between first linear end portion 86 and second linear end portion 88 with first and second longitudinal axes 90 and 92, respectively. As illustrated in FIG. 9, the linear bar arrangement of device 10 may be secured to a weighted pulley and rope system 94 which is sometimes described as a "lat" machine in the weight lifting vernacular. The lat machine or weighted pulley and rope system 94 includes flexible wire or rope 98, a first pulley 100, a second pulley 102, and a weight 104. Pulleys 100 and 102 are mounted to a support or wall 106, and wire 94 is looped over both pulleys with weight 104 at a first end, and eyelet 95 or buckle 96 is provided at the second or opposite end for mounting bar 82. Thereafter the lat machine may be operated in the usual manner. As shown, the rotatable grips 12 or auxiliary grips 50 are rotatable while the user is simultaneously exercising other muscle groups with weight system 94.

As a preferred embodiment, linear bar 82 and first and second linear end portions 86, 88 cooperate to define and lie in the same plane. In this common plane the first and second linear portions are displaced an approximately equivalent angular distance from the reference axis 84 by an angle of about 40° downward from the horizontal as shown in FIG. 10. An eyelet or eyelet hook 95 may be provided on linear bar 82 for attachment to various apparatus such as system 94 and to accommodate the need for a portable or interchangeable apparatus 10. In this structure eyelet 95 may be secured to rope or wire 98 at buckle 96 to cooperate with pulley system 94.

In FIG. 9, one method of utilizing the linear bar 82 arrangement is for the user to rotate the grips 50 to exercise a first group of muscles while he is simultaneously utilizing the pulley and weight system 94. The user may again reverse by 180° the handle grip to reverse the direction of rotation with relation to his hands and wrist.

From the foregoing, it should be apparent that the invention provides a novel exercise device which provides variable resistance to twisting of a pair of rotatable grips, has a variable weight, and is compact and easily assembled. The invention is not limited to the embodiments described above, or to any particular embodiment, but is defined by the following claims.

What is claimed is:

1. An exercise device comprising:

a nonlinear bar which includes first and second substantially linear end portions;

first and second rotatable grips, the first rotatable grip being disposed coaxially of the first linear end portion of the bar, the second rotatable grip being disposed coaxially of the second linear end portion of the bar, both grips being rotatable with respect to the bar;

biasing means applying torque to the grips, which biasing means is a pair of opposite-handed torsional coil springs, each being disposed within a respective one of said grips for torsion loading said grips in opposite direction;

stop means associated with each of the grips defining a limited range of motion for each of the grips relative to their respective end portions of the bar; and adjustment means for varying the torque applied by the biasing means;

the biasing means being oriented so that the torque is applied to the respective grips symmetrically to rotate both wrists in the same direction;

whereby a user may provide equivalent exercise for both arms simultaneously;

a first substantially spherical gripping means attached to an end of the first rotatable grip to be gripped and turned to rotate the first grip; and a second substantially spherical gripping means attached to an end of the second rotatable grip to be gripped and turned to rotate the second grip.

2. An exercise device comprising:

a nonlinear bar which includes first and second substantially linear end portions;

first and second rotatable grips, the first rotatable grip being disposed coaxially of the first linear end portion of the bar, the second rotatable grip being disposed coaxially of the second linear end portion of the bar, both grips being rotatable with respect to the bar;

first biasing means applying torque to said first grip, which first biasing means is a torsional spring operable to have its torque load increased by one of a clockwise and counterclockwise rotation of said first grip about said bar;

second biasing means applying torque to said second grip independently of said first biasing means, which second biasing means is a torsional spring operable to have its torque load increased by the same one of a clockwise and counterclockwise rotation of said second grip about said bar, said first and second biasing means being loaded in opposite directions;

stop means associated with each of the grips defining a limited range of motion for each of the grips relative to their respective end portions of the bar;

adjustment means for independently varying the torque applied by the first and second biasing means respectively;

the biasing means being oriented so that torque is applied to the respective grips symmetrically, a first substantially spherical gripping means attached to an end of the first rotatable grip to be gripped and turned to rotate the first grip; and a second substantially spherical gripping attached to an end of the second rotatable grip to be gripped and turned to rotate the second grip.

* * * * *